US007331282B2

(12) United States Patent
De Winter et al.

(10) Patent No.: US 7,331,282 B2
(45) Date of Patent: Feb. 19, 2008

(54) COMPACTING MECHANISM FOR A REFUSE CONTAINER

(75) Inventors: Koen De Winter, Montreal (CA); Tibor Ernst, Brussels (BE); Yvan LaPorte, Quebec (CA)

(73) Assignee: Garbage Genie Concept 2000 Limited, Dublin (IE)

( * ) Notice: Subject to any disclaimer, the term of this patent is extended or adjusted under 35 U.S.C. 154(b) by 0 days.

(21) Appl. No.: 10/556,836

(22) PCT Filed: May 15, 2004

(86) PCT No.: PCT/IE2004/000069

§ 371 (c)(1),
(2), (4) Date: Oct. 13, 2006

(87) PCT Pub. No.: WO2004/101398

PCT Pub. Date: Nov. 25, 2004

(65) Prior Publication Data

US 2007/0071914 A1 Mar. 29, 2007

(30) Foreign Application Priority Data

May 15, 2003 (IE) ..... S2003/0369

(51) Int. Cl.
*B30B 1/04* (2006.01)
*B30B 15/06* (2006.01)

(52) U.S. Cl. ..... 100/226; 100/229 A; 100/246; 100/247; 100/295

(58) Field of Classification Search ..... 100/226, 100/227, 228, 229 A, 229 R, 240, 245, 246, 100/247, 255, 265, 283, 295; 53/527; 220/908
See application file for complete search history.

(56) References Cited

U.S. PATENT DOCUMENTS

| | | | | |
|---|---|---|---|---|
| 4,658,720 | A * | 4/1987 | Massonnet | 100/226 |
| 5,090,309 | A * | 2/1992 | Lai | 100/226 |
| 6,314,874 | B1 * | 11/2001 | Martorella | 100/226 |
| 6,851,357 | B1 * | 2/2005 | Martorella et al. | 100/226 |
| 6,889,604 | B2 * | 5/2005 | Ernst | 100/226 |

FOREIGN PATENT DOCUMENTS

DE 29919933 U1 * 1/2000

* cited by examiner

*Primary Examiner*—Jimmy T. Nguyen
(74) *Attorney, Agent, or Firm*—Cowan, Liebowitz & Latman, P.C.

(57) ABSTRACT

A compacting mechanism for fitting a surface over a refuse container comprising a support member (10) for fitting to the surface, the support member having an aperture (16) which in use is in register with an aperture in the surface. A compacting plate (12) is mounted under the support member, and is coupled to an actuator rod (14) through the aperture in the support member such that the rod may be manoeuvred from a storage position wherein the rod lies along the support member across the surface and the plate is drawn up under the surface to an operative position wherein the rod stands upright over the aperture in the support and may be pushed downwardly through the registering apertures to push the plate down into the container.

7 Claims, 9 Drawing Sheets

COMPACTING MECHANISM FOR A REFUSE CONTAINER

BACKGROUND OF THE INVENTION

This invention. relates to a compacting mechanism for a refuse container.

Our prior published Patent Specification WO 01/46042 describes a lid for a refuse container, the lid containing an integral compacting mechanism.

It is an object of the invention to provide a compacting mechanism which can be retro-fitted or fitted as original equipment to the top surface of a refuse container or any surface above a bin fitted or placed below that surface, e.g. kitchen counter, kitchen cabinet, shelf, mobile service trolley or bin for garden or industrial compactable waste. Such a surface may be, but is not limited to, the non-opening roof of the type of refuse container used in "fast-food" establishments, which have a side opening for the insertion of refuse, or other containers used in restaurants, hospitals, domestic or industrial kitchens or airline style service trolleys with a removable inside bin fitted with a plastic removable refuse sack. However, the invention is not limited to retro-fitting, and it may be fitted to-new installations.

BRIEF SUMMARY OF THE INVENTION

According to the present invention there is provided a compacting mechanism for fitting to a surface over a refuse container, the compacting mechanism comprising a support member for fitting to the said surface, the support member having an aperture which in use is in register with an aperture in the said surface, a compacting plate mounted under the support member, an actuating rod, and means coupling the compacting plate to the actuating rod such that the rod may be manoeuvred from a storage position wherein the rod lies along the support member across the said surface and the plate is drawn up under the said surface to an operative position wherein the rod stands upright over the aperture in the support member and may be pushed downwardly through the registering apertures to push the plate down into the container.

BRIEF DESCRIPTION OF THE DRAWINGS

An embodiment of the inventions will now be described, by way of example, with reference to the accompanying drawings, in which.

DETAILED DESCRIPTION

Figure 1:
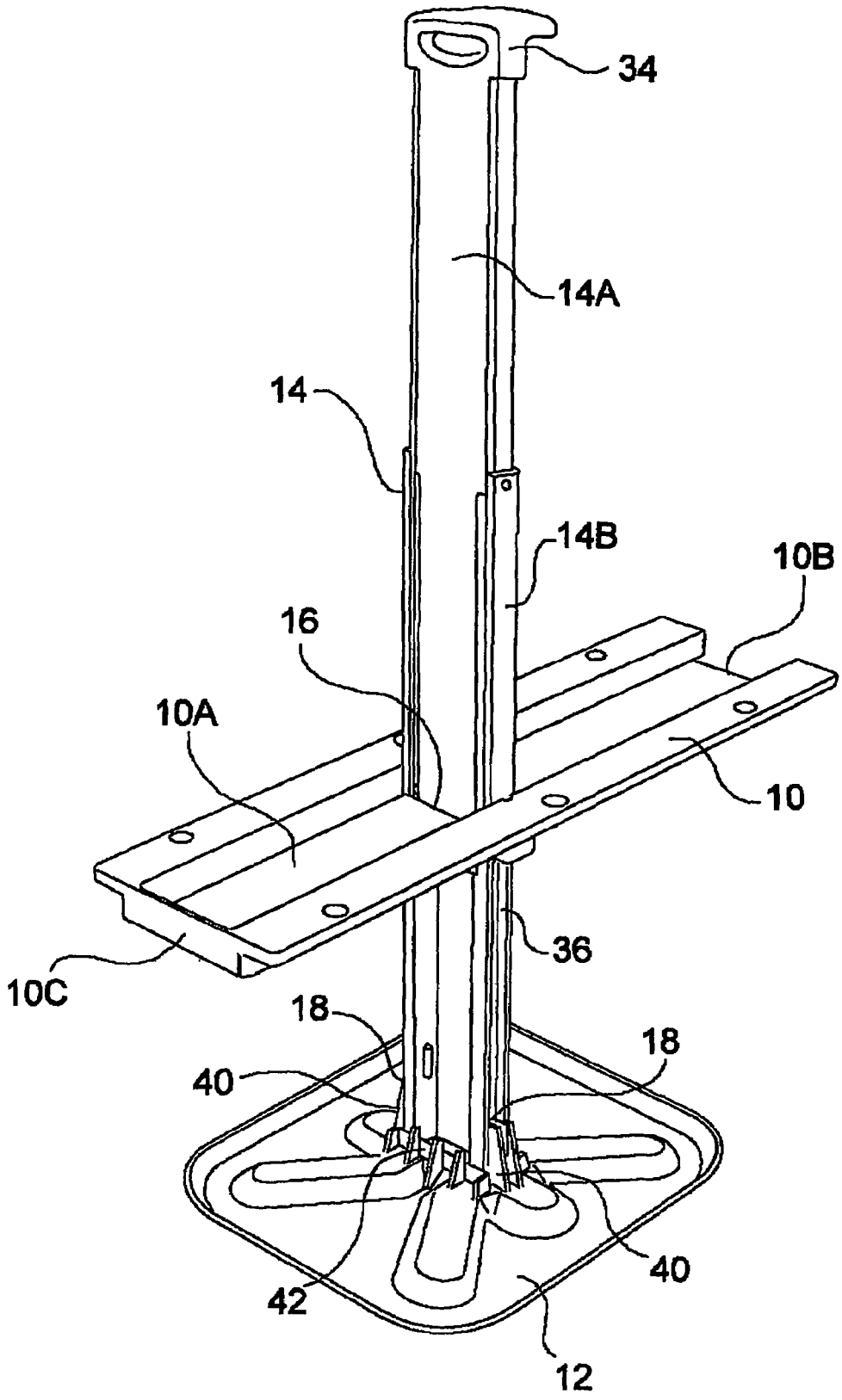
FIG. 1 is a perspective view of an embodiment of compacting mechanism according to the invention in a its operative position, although omitting the refuse container to which it is fitted in use.

Referring to the drawings, the basic elements of the compacting mechanism are a channel-shaped support member 10 for fitting to a non-opening roof of a refuse container having a side opening for the insertion of refuse, a compacting plate 12, an actuating rod 14 passing through an aperture 16 in the support member 10 and inwardly directed projections 18 on the plate slidably coupling the plate 12 to the rod 14 in a manner to be described.

Figure 2:
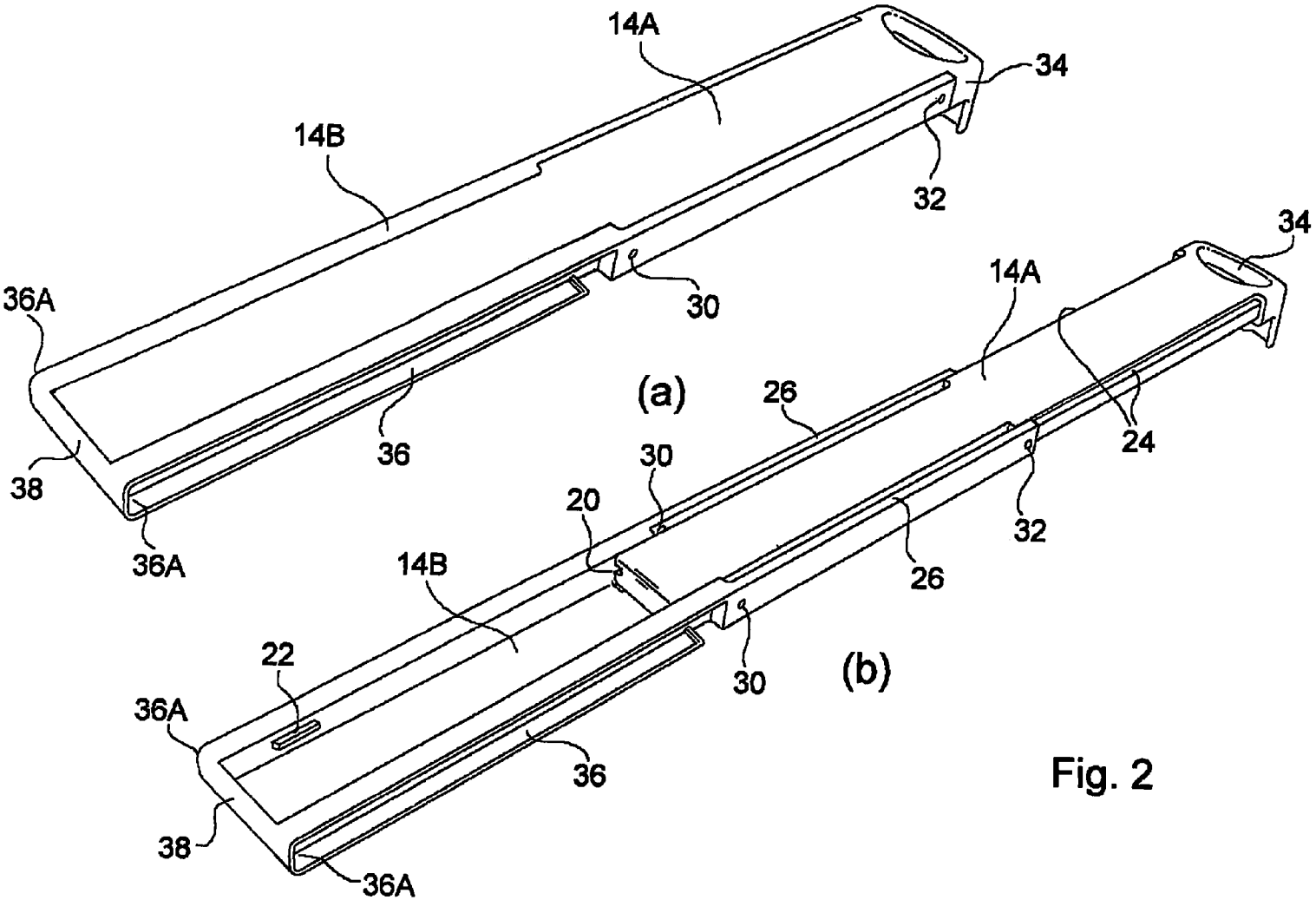
FIGS. 2 (*a*) and 2 (*b*) are top perspective views respectively of the telescopic actuating rod of FIG. 1 in its fully retracted and fully extended states.
Figure 3:
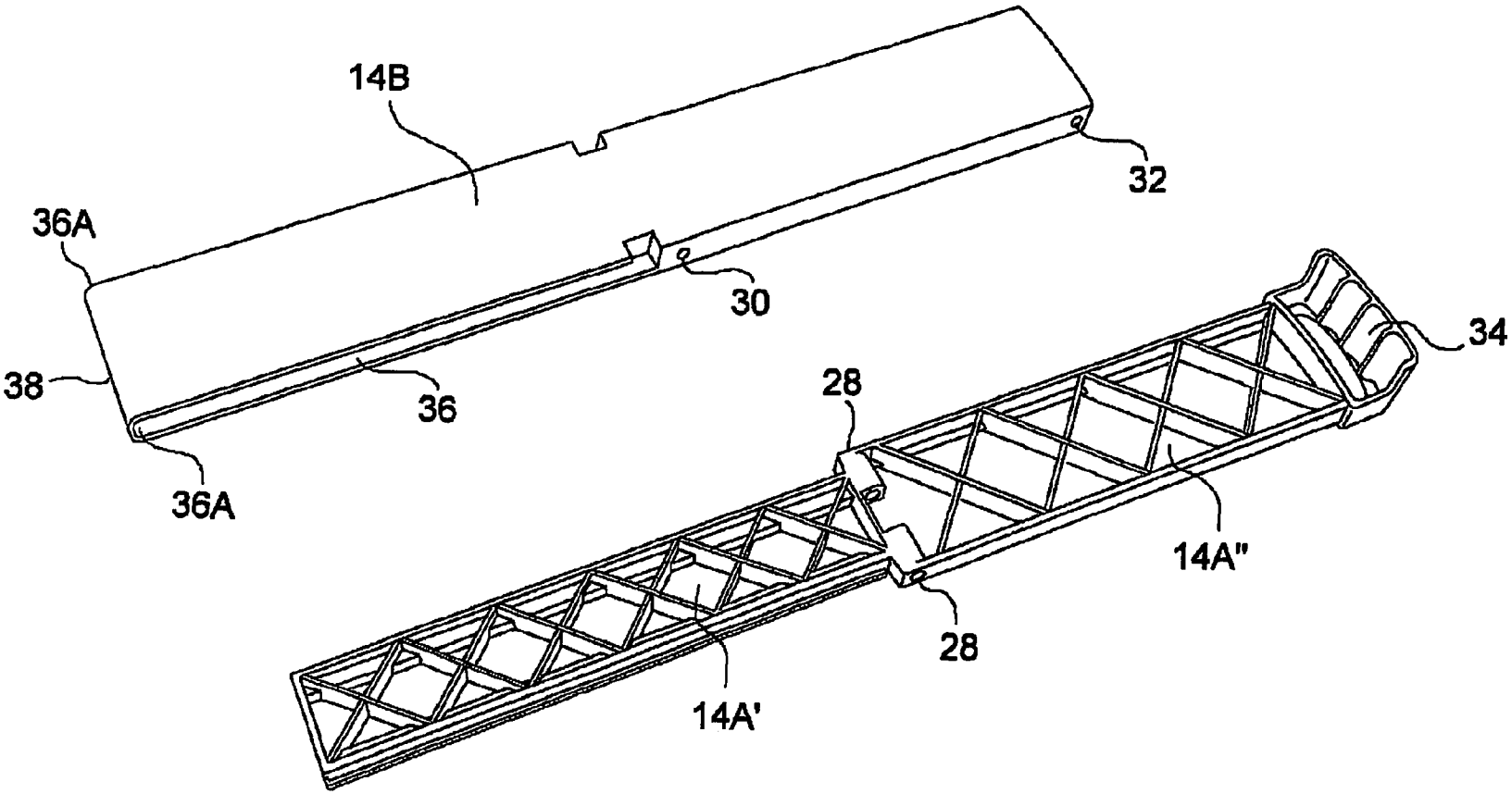
FIG. 3 are perspective views from below of the two components making up the telescopic actuating rod.
Figure 4:
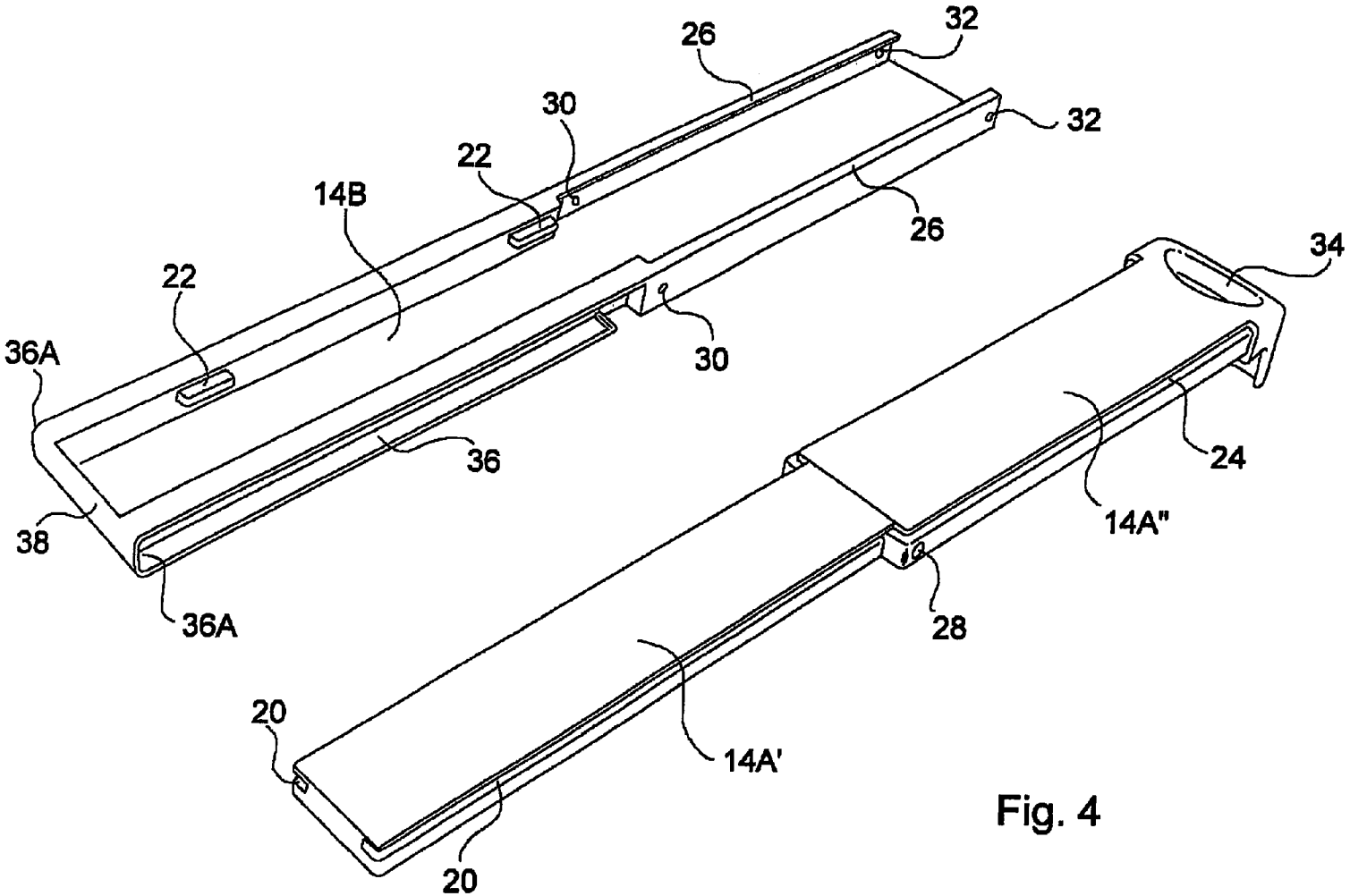
FIG. 4 are perspective views from above of the two components making up the telescopic actuating rod.

The actuating rod 14 is adjustable in length, being formed in two parts, FIGS. 2 to 4, an inner part 14A which is telescoped within an outer part 14B formed as a shallow channel. In particular, the inner part 14A has a relatively narrow rear portion 14A' (FIG. 4) with grooves 20 along opposite edges which are slidably engaged by fixed projections 22 on the inside walls of the rear of the outer part 14B. The inner part 14A also has a relatively wider front portion 14A" having shallow recesses 24 along opposite edges which slide under overhanging ledges 26 along opposite edges of the front of the outer part 14B. In this way the inner part 14A is guided for sliding movement into and out of the outer part 14B.

At the junction of its narrower and wider portions the inner part 14A has two laterally outwardly biased ball members 28 which resiliently engage a first pair of holes 30 in the opposite sides of the part 14B when the part 14A is fully retracted into the part 14B and which resiliently engage a second pair of holes 32 in the opposite sides of the part 14B when the part 14A is fully extended out of the part 14B. Thus the inner part 14A is resiliently retained at each of its fully retracted and fully extended positions. The inner part 14A has a handgrip 34 at its free end by which it may be drawn out of and pushed into the part 14B.

The channel-like outer part 14B of the actuating rod 14 has a groove 36 extending along each external edge about halfway along the part 14B from its closed end 38. Each groove 36 is slidably engaged by a respective inwardly directed projection 18 on the plate 12. In the operative position of the mechanism, FIG. 1, the actuating rod 14 is orientated upright and extends through the aperture 16 in the support member 10 so that the projections 18 are at the closed ends 36A, FIG. 2 (*a*), of the grooves 36. The projections 18 are formed at the top ends of respective arms 40 which extend upwardly from a bracket 42 moulded or otherwise attached to the plate 12. The length of the arms 40 is such that, assuming no upward force is applied to the plate 12, the closed end 38 of the actuating rod 14 is clear of the bracket 40. In this situation the plate 12 hangs freely from the end 38 of the rod 14 and is capable of rotation about the axis of the projections 18 which rest on the closed ends 36A of the grooves 36.

In use, as will be described, the support member 10 is fitted to a non-opening roof of a refuse container with the aperture 16 in register with a like aperture in the container roof, so that the actuating rod 14 passes through both the aperture 16 and the corresponding aperture in the container roof. Thus, if the rod 14 is pushed downwardly using the handgrip 34 to compact refuse in the container, the upward force on the plate 12 will force the end 38 of the rod 14 into the bracket 42 so that the plate 12 is then locked against rotation relative to the rod 14. However, after the refuse has been compacted, lifting the rod 14 removes the upward force on the plate 12 and allows the end 38 of the rod 14 to disengage from the bracket 42 so that the plate can once again rotate relative to the rod 14.

Figure 5:
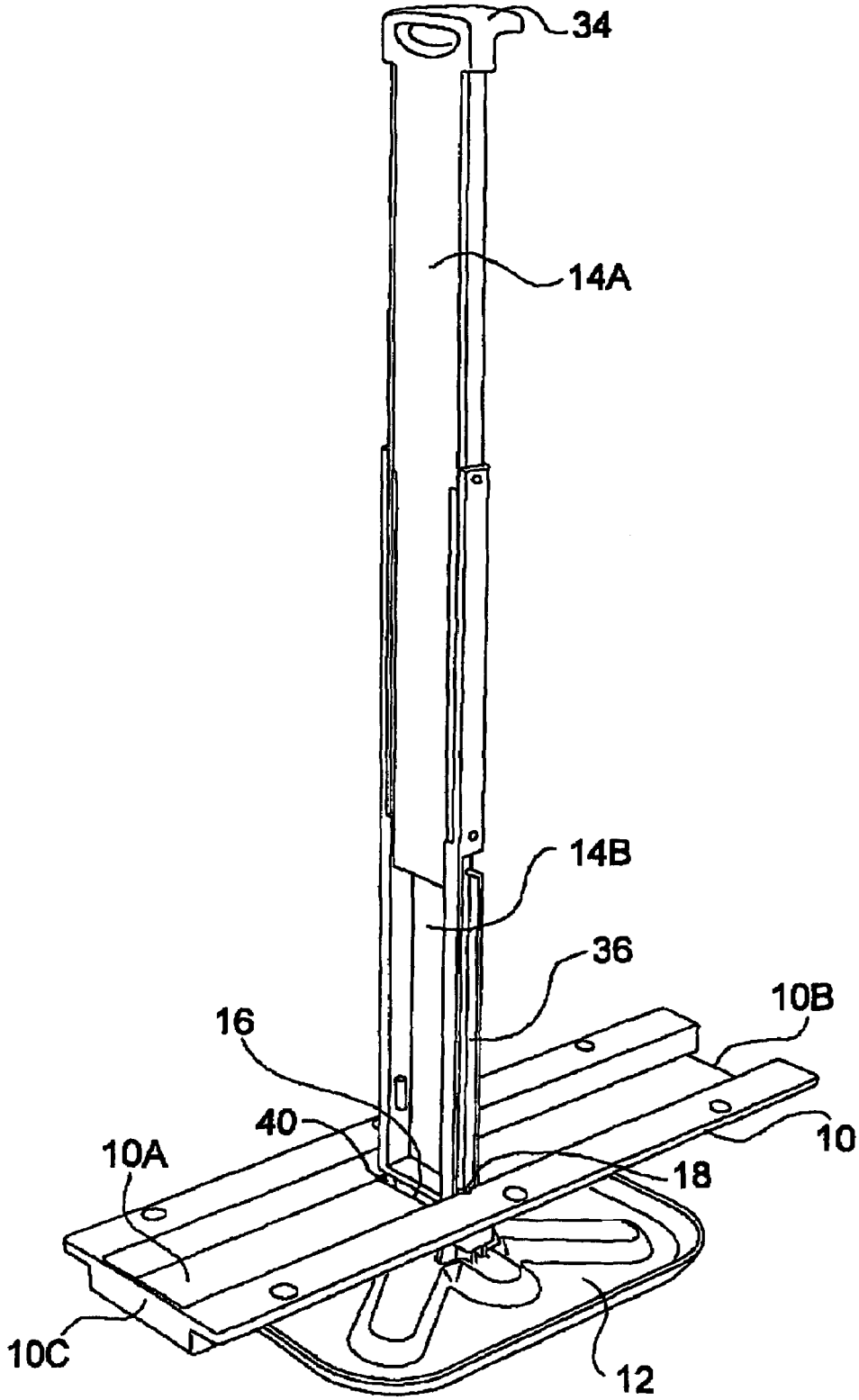
FIGS. 5 to 7 show successive stages in the storage of the mechanism from the operative position shown in FIG. 1.

In order to store the compacting mechanism, the rod 14 is drawn upwardly until the end 38 is above the aperture 16 in the support member 10, FIG. 5. This draws the top ends of the arms 40 through the aperture 16 since the projections 18 remain engaged in the grooves 36 at their closed ends 36A, and hence the plate 12 is drawn up under the member 10.

Figure 6:
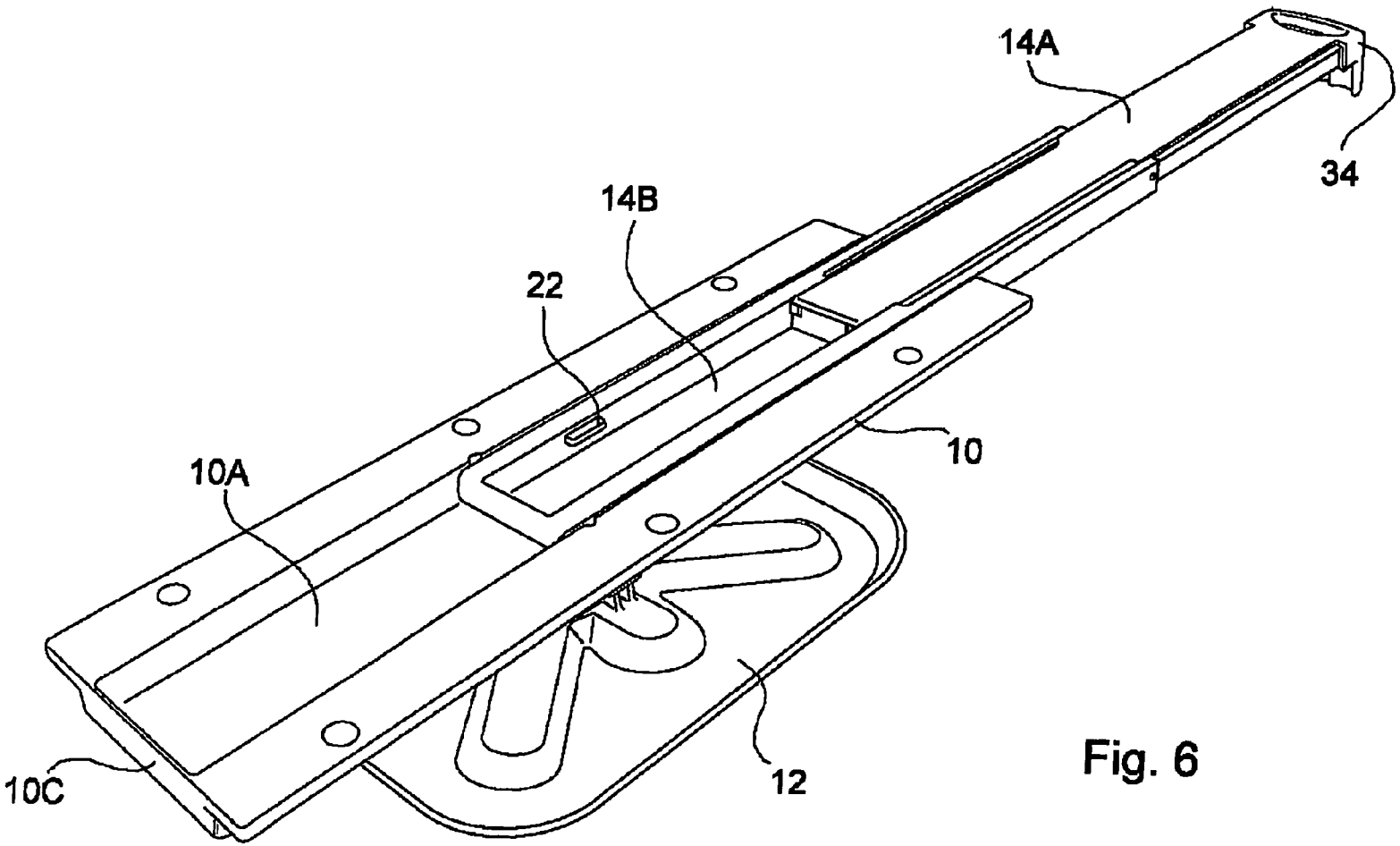
Figure 7:
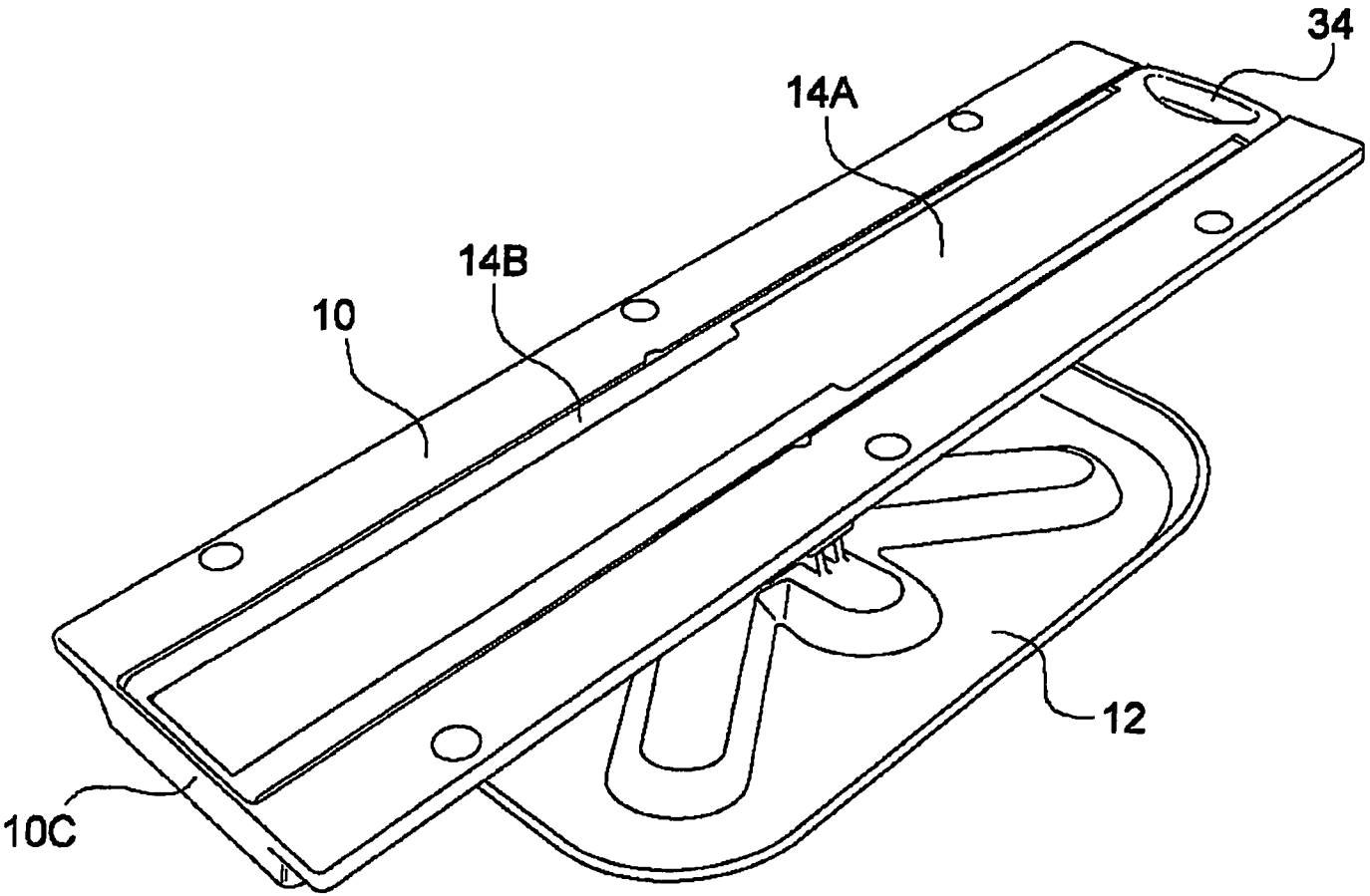

Now, FIG. 6, the entire rod 14 is rotated about the projections 18 so that it lies in the channel 10A of the support member 10, the channel 10A being open at one end 10B to allow this. Finally, FIG. 7, the handgrip 34 is pushed to collapse the two parts 14A, 14B and slide the entire collapsed rod 14 along its own axis fully into the-channel 10A so that the end 38 of the part 14B comes to rest against the closed end 10C of the channel 10A. During the sliding of the part 14B along the channel 10A the projections 18, which are of course fixed longitudinally of the channel, slide along the grooves 36.

To bring the mechanism from the storage position to the operative position these actions are reversed, i.e. first the rod 14 is slid along its own axis along the channel 10A until the ends 36A of the channels 36 come to engage the projections 18 (FIG. 6), then the rod 14 is rotated upright over the aperture 16 (FIG. 5), and finally the rod is pushed downwardly through the aperture 16 (FIG. 1).

Figure 8:
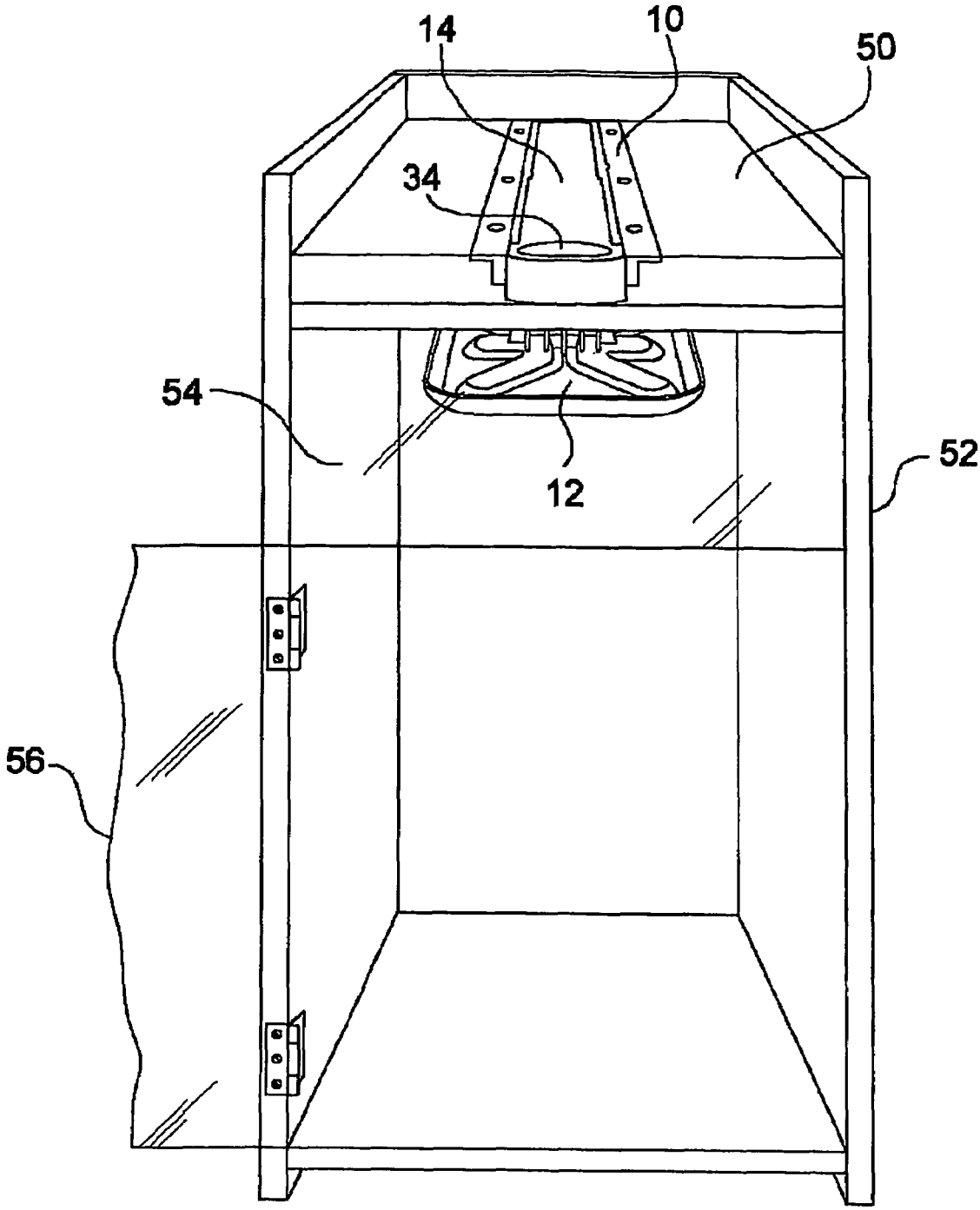
FIG. 8 shows the compacting mechanism fitted to a refuse container, the mechanism being in its storage position.
Figure 9:
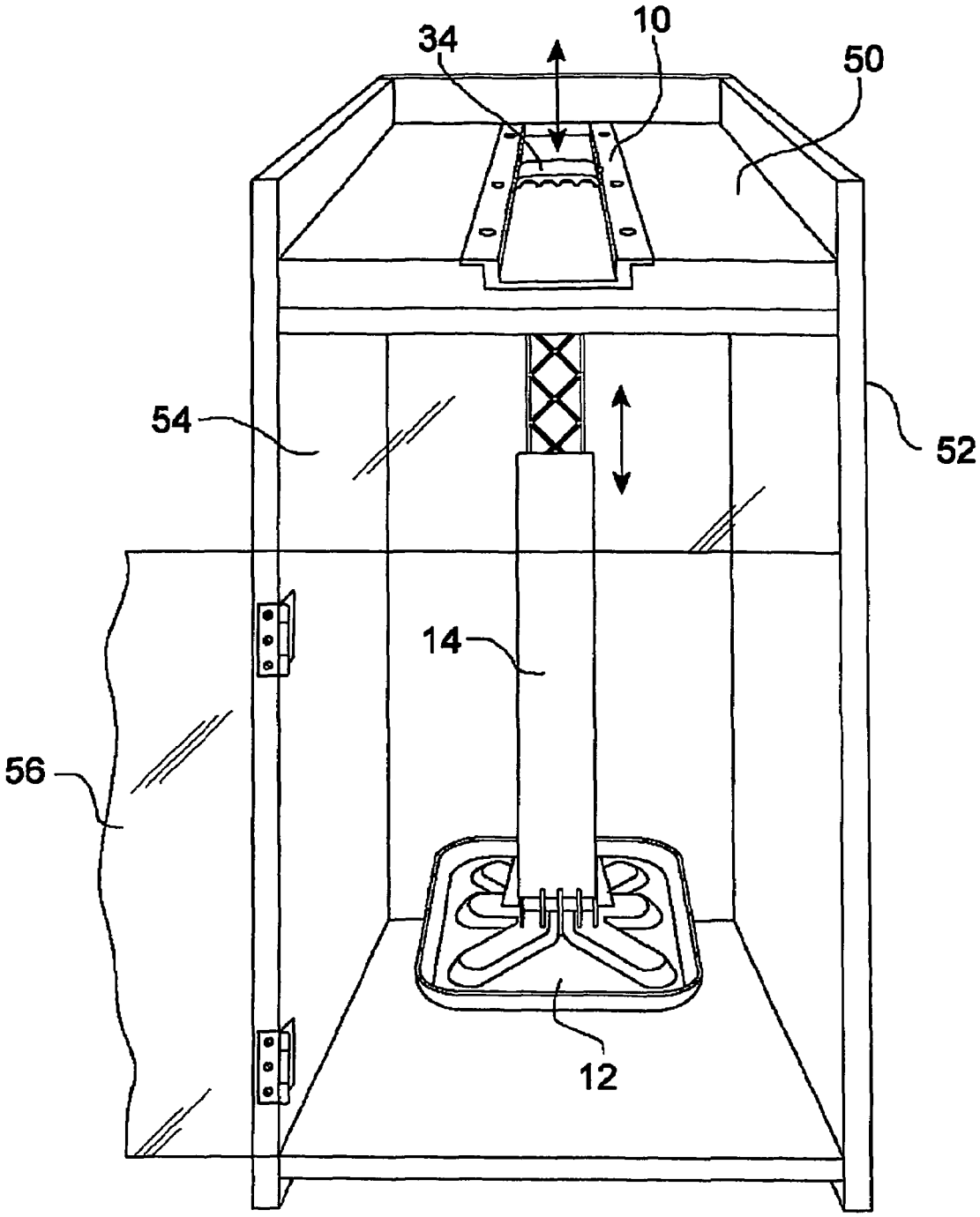
FIG. 9 shows the compacting mechanism fitted to a refuse container and deployed in its operative position.

FIGS. 8 and 9 show the compacting mechanism fitted to the non-opening roof 50 of a refuse container 52 of the kind used in fast-food establishments, the support member 10 being recessed into the roof 50 with its channel 10A extending transversely across the roof.

The roof 50 has an aperture in register with the aperture 16 in the member 10 to allow the actuating rod 14 to pass though both apertures. The container has a side opening which is covered by an inwardly opening flap 54 which is hinged (not shown) along its top edge to the roof 50 to allow refuse to be placed into a bin (also not shown) in the container 52, the bin being lined with a removable sack. The container 52 has an outwardly opening door 56 to allow a bin containing a full refuse sack to be removed and replaced with an empty one.

FIG. 8 shows the compacting mechanism in the storage position wherein the rod 14 lies along the channel 10A in the support member 10 and the plate 12 is drawn under the container roof 50, while FIG. 9 shows the mechanism in its operative position wherein the plate 12 is within the not-shown bin in the container 52. To avoid over-compaction, the resilient retaining means 28,32 which cooperate to hold the two parts 14A, 14B of the actuating rod 14 in its fully extended position are overcome upon the compacting plate 12 meeting a given resistance in use so that the one part 14A retracts into the other 14B to substantially cease further compaction.

Alternatively, not shown, the two parts 14A, 14B can be releasably lockable in their extended position so that no such retraction under pressure occurs but rather they need to be manually released to effect retraction. If desired, a one piece non-extendible rod 14 can be used, particularly where a long reach is not required.

When the mechanism is in its operative position the plate 12 can be removed from the rod 14 for cleaning by tipping it sideways and sliding the projections 18 up the grooves 36, i.e. away from their lower ends 36A, to the gaps in the grooves next to the holes 30, FIG. 2.

Although the mechanism has been described in use with the type of refuse container used in "fast-food" establishments which have a side opening for the insertion of refuse, the invention can be used in any situation, commercial or domestic, where a surface which can receive the support member 10 overlies a refuse container which can receive the plate 12, and the mechanism can be manufactured in various sizes to fit these various applications.

The invention is not limited to the embodiment described herein which may be modified or varied without departing from the scope of the invention.

The invention claimed is:

1. A compacting mechanism for fitting to a surface, the surface is positioned over a refuse container, the compacting mechanism comprising a support member for fitting to said surface, the support member having an aperture which in use is in register with an aperture in said surface, a compacting plate mounted under the support member, an actuating rod, a means for coupling the compacting plate to the actuating rod such that the rod may be manoeuvred from a storage position wherein the rod lies along the support member across said surface and the plate is drawn up under said surface to an operative position wherein the rod stands upright over the aperture in the support member and may be pushed downwardly through the registering apertures to push the plate down into the container, wherein the compacting plate is slidably and pivotally coupled to the actuating rod such that in the storage position of the rod the plate is coupled to the rod at a point intermediate its ends, the rod being manoeuvrable to the operative position by sliding the rod along its own axis until the coupling means reaches one end of the rod, and then rotating the rod upwardly about said one end, and wherein the support member comprises a channel member extending in use across said surface, the aperture in the support member being formed in a base of the channel and the actuating rod being located in and slidable along the channel, the base of the channel forming an underside of the support member and the support member comprising a lip extending along each of opposing longitudinal edges of the channel, and the lips extending outwardly from the channel for fitting the support member to the surface.

2. A compacting mechanism as claimed in claim 1, wherein the other end of the actuating rod has a handgrip.

3. A compacting mechanism as claimed in claim 1, wherein the actuating rod is adjustable in length.

4. A compacting mechanism as claimed in claim 3, wherein the actuating rod comprises at least two parts which are slidable one relative to the other to adjust the length of the rod.

5. A compacting mechanism as claimed in claim 4, wherein the actuating rod includes resilient retaining means for holding the two parts in an extended position of the rod, said resilient retaining means being overcome upon the compacting plate meeting a given resistance in use so that the one part retracts into the other to substantially cease further compaction.

6. A compacting mechanism as claimed in claim 2, wherein the actuating rod is adjustable in length.

7. A compacting mechanism as claimed in claim 6, wherein the actuating rod comprises at least two parts which are slidable one relative to the other to adjust the length of the rod.

* * * * *